United States Patent [19]

Scott

[11] Patent Number: 4,858,763

[45] Date of Patent: Aug. 22, 1989

[54] FLUORESCENT LIGHT HOLSTER

[76] Inventor: Ronnie E. Scott, 2001 S. 22nd St., McClennan County, Waco, Tex. 76706

[21] Appl. No.: 180,238

[22] Filed: Apr. 11, 1988

[51] Int. Cl.[4] ..... B65D 85/42

[52] U.S. Cl. ..... 206/419; 224/236; 383/40

[58] Field of Search ..... 206/418, 419, 420, 443; 383/38, 39, 40; 224/236

[56] References Cited

U.S. PATENT DOCUMENTS

| | | | |
|---|---|---|---|
| 471,257 | 3/1892 | Lorenz | 383/39 |
| 1,286,597 | 12/1918 | Jennings . | |
| 1,437,349 | 11/1922 | Moore, Jr. | 383/39 X |
| 2,850,152 | 9/1958 | Marrufo . | |
| 4,330,073 | 5/1982 | Clark | 224/223 |
| 4,613,042 | 9/1986 | Aeschliman | 206/419 |
| 4,773,535 | 9/1988 | Cook | 383/38 X |

FOREIGN PATENT DOCUMENTS

| | | | |
|---|---|---|---|
| 859819 | 1/1961 | United Kingdom | 206/443 |

*Primary Examiner*—William Price
*Attorney, Agent, or Firm*—Alan W. Lintel

[57] ABSTRACT

A light bulb holster (10) is provided in which pockets (18,36) are used to hold a plurality of tubular bulbs (22). A flap (28) is operable to cover the top ends of the bulbs (22) during transport and to secure the holster (10) to a ladder brace at the work site.

10 Claims, 1 Drawing Sheet

FLUORESCENT LIGHT HOLSTER

TECHNICAL FIELD OF THE INVENTION

This invention pertains in general to an electric lamp holder, and more particularly to a flexible holster for aiding the process of changing fluorescent light bulbs.

BACKGROUND OF THE INVENTION

During installation of fluorescent light bulbs, it is often necessary to employ a stepladder in order to reach the fluorescent lamp fixture. Since both hands are normally necessary to remove or install a fluorescent lamp from the fixture, it is necessary to utilize some aid in transferring the fluorescent light bulbs to and from the fixture.

U.S. Pat. No. 4,613,042 to Aeschliman discloses one such device. The Aeschliman comprises a plurality of tapered, rigid tubes of different lengths, integrally jointed together, such that a plurality of lamps can be held by the tubes at selected heights. The tubes may be clamped to one end of a stepladder using a vise-like mechanism.

The Aeschliman device has several deficiencies. First, only a small portion of one end of the fluorescent light bulb is contained in the tubes, thereby exposing a large length of the fluorescent light bulb. Thus, the entire bulb is not protected from external forces. The Aeschliman device is rigidly attached to the ladder, and a force imparted to the bulbs would result in their breakage or dislodging. Furthermore, the Aeschliman device is not suitable for holding bulbs in a non-vertical position. As a result, the Aeschliman device cannot be used to aid in transporting the bulbs, and therefore has only limited application.

Therefore, a need has arisen in the industry for a holster for holding light bulbs, which is easily transportable, and which offers maximum protection to the bulbs.

SUMMARY OF THE INVENTION

In accordance with the present invention, a light bulb holster is provided which substantially eliminates or prevents the disadvantages and problems associated with prior light bulb holding devices.

The light holster of the present invention comprises a flexible bag including a plurality of pockets for holding long light bulbs. Cushions are provided at the bottom of each pocket to protect the ends of the bulb. A loop is provided on the back of the bag for carrying the holster, or for attaching the bag to the user's belt. A top flap may be secured to the front of the bag, thereby securing the light bulbs within the pockets, or to the back of the bag to provide a attachment to the brace of a ladder.

BRIEF DESCRIPTION OF THE DRAWINGS

For a more complete understanding of the present invention and the advantages thereof, reference is now made to the following descriptions taken in conjunction with the accompanying drawings, in which.

DETAILED DESCRIPTION OF THE INVENTION

Figure 1:
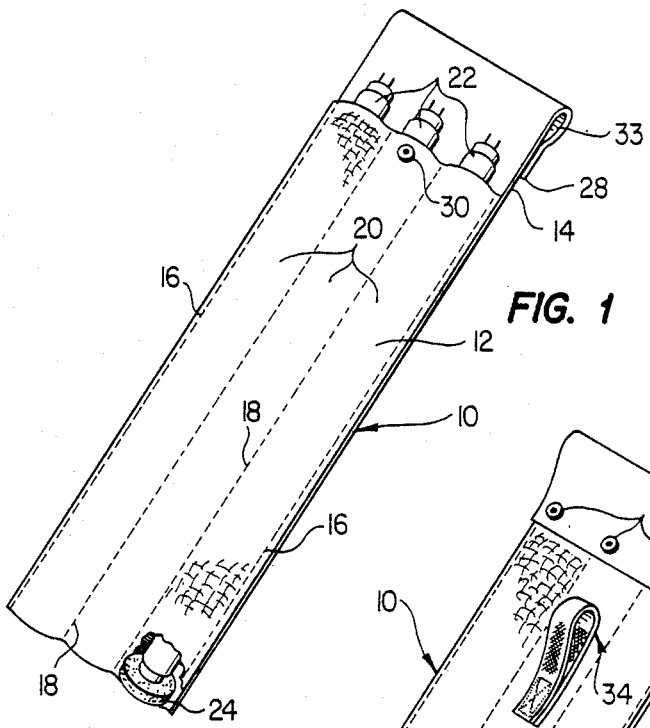
FIG. 1 illustrates a front perspective view of the light holster of the present invention, having a cutaway view showing the cushioning at the bottom of the holster's pockets.
Figure 2:
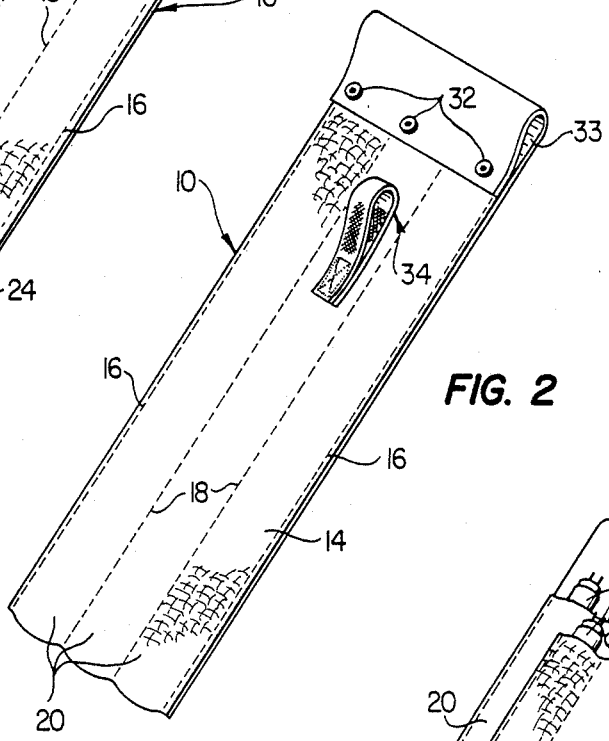
FIG. 2 illustrates a back perspective view of the light holster of the present invention.

The preferred embodiment of the present invention is best understood by referring to FIGS. 1-2 of the drawings, like numerals being used for like and corresponding parts of the various drawings.

FIGS. 1 and 2 illustrate perspective front and back views, respectively, of the present invention. The light holster 10 comprises a bag formed of front and back pieces of material 12 and 14, respectively. Outside seams 16 secure the edges of the front and back material 12 and 14 together, creating an enclosure therebetween. Interior seams 18 create pockets 20 for holding fluorescent light bulbs 22, or other tubular light bulbs. FIG. 1 illustrates a cutaway view of the bottom of a pocket 20. A pad 24 is disposed at the bottom of the pockets 20 to protect the ends of the bulbs 22. If desired, the interior sides of the front and back material may be padded to protect the bulbs 22 from damage by exterior forces.

The back material 14 includes an extended portion providing a flap 28. A front snap 30 is provided on the front material 12 for securing the flap 28 in a position covering the bulbs 22. In this position, the front snap 30 engages a corresponding snap (not shown) on the interior side of the flap 28.

Back snaps 32 are provided on the flap 28 and the exterior of the back material 14. The flap 28 may be folded towards the back of the holster 10 and engaged using the back snaps, in order form a channel 33 within the flap 28. A strap 34 is provided for carrying the holster 10.

In operation, the holster 10 may be used by a workman to carry a plurality of bulbs 22 in a protective container. With the flap 28 engaged with the front snap 30, the bulbs are protected on all surfaces and held within the pockets 20.

At the work site, the flap 28 may be disposed about one of the braces disposed on the sides of a ladder and engaged using the back snaps 32. Thus, the holster 10 may be attached to the brace of a ladder may be enclosed in the channel 33 while the workman is installing the light bulbs 22, such that the light bulbs are readily available without descending the ladder to obtain more bulbs 22. Hence, the present invention provides a more efficient light changing procedure and increases safety by reducing movement on the ladder.

Since the holster 10 is free to pivot about the brace to which it is attached, the light bulbs are protected from exterior forces on the bulbs 22.

It should be noted that the flap 28 may be disposed about other substantially horizontal support structures in lieu of a ladder brace, if a ladder brace is not available.

In the preferred embodiment, the front and back material 12 and 14 of the holster 10 is a nylon material; however, other flexible materials may also be used. Furthermore, the snaps 30 and 32 could be replaced by other securing means, such as a hook and loop fastening material (as is sold under the mark "Velcro") or by using zippers.

Figure 3:
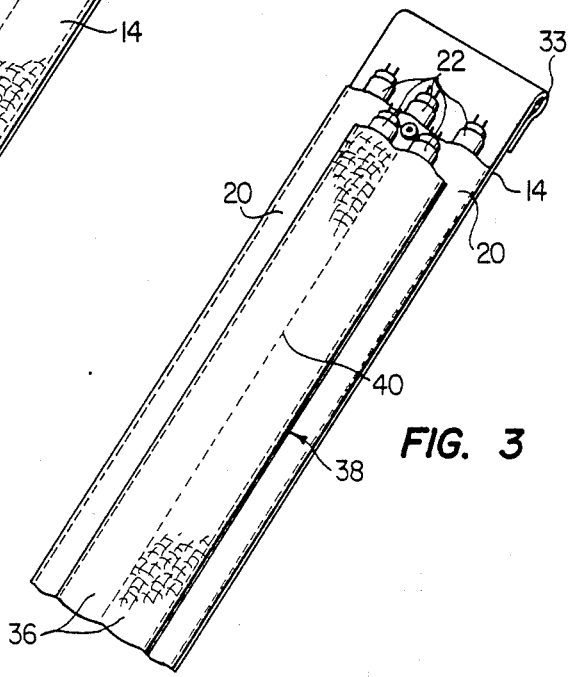
FIG. 3 illustrates a second embodiment of the present invention, operable to hold an increased number of bulbs.

FIG. 3 illustrates a second embodiment of the present invention wherein additional pockets 20 are provided. Pockets 36 are formed by sewing an additional piece of material 38 onto the front material 12 and forming the pockets 36 by creating interior seams 40. Preferably, the additional pockets 36 are offset with the pockets 20, such that the bulbs placed in the additional pockets 36 lie between the bulbs placed in the pockets 18.

Although the preferred embodiment of the invention has been described in detail, it should be understood that various changes, substitutions and alterations can be made therein without departing from the spirit and scope of the invention as defined by the appended claims.

What is claimed is:

1. An apparatus for holding elongated light bulbs comprising:

first and second layers of a flexible material attached together to define an enclosure therebetween;

means for defining a plurality of pockets within said enclosure, each pocket having an open end for receiving the light bulbs;

said second layer having an extended portion operable to fold about a support structure; and fastening means to secure said extended portion to said second layer, such that said pockets may be pivotally attached to said support structure.

2. The apparatus of claim 1 and further comprising frontal fastening means for securing said extended portion to said first layer such that said open ends of said pockets may be covered by said extended portion.

3. The apparatus of claim 1 wherein said fastening comprises a snap.

4. The apparatus of claim 1 wherein said fastening means comprises a hook and loop material.

5. The apparatus of claim 1 wherein said means for defining comprises seams connecting said first and second layers at predetermined widths.

6. The apparatus of claim 1 and further comprising padding material disposed at the bottom of said pockets.

7. The apparatus of claim 1 and further comprising a third layer of flexible material attached to said first layer and defining an enclosure therebetween.

8. The apparatus of claim 7 and further comprising means for defining pockets between said first and third layers.

9. The apparatus of claim 1 wherein said pockets extend the length of the bulbs.

10. An apparatus for holding tubular light bulbs comprising:

a front sheet of flexible material;

a back sheet of flexible material peripherally attached to said front sheet and having an extended flap portion;

interior seams defining pockets between said front and back sheets;

padding material disposed at the bottom of said pockets to prevent damage to the ends of said bulbs;

back fastening means for securing the flap to said back sheet to form a loop about a support structure; and front fastening means for securing said flap to said front sheet to cover said pockets.

* * * * *